United States Patent [19]

Ahlgrim et al.

[11] 4,203,637

[45] May 20, 1980

[54] ELECTRICAL POWER TRANSMITTING APPARATUS

[75] Inventors: Michael Ahlgrim, Erftstadt; Gerhard Mietens, Hürth-Efferen; Wilfried Krieger, Brül, Günter Sorbe, Hürth, Fed. Rep. of Germany

[73] Assignee: Hoechst Aktiengesellschaft, Frankfurt am Main, Fed. Rep. of Germany

[21] Appl. No.: 956,856

[22] Filed: Nov. 1, 1978

[30] Foreign Application Priority Data

Nov. 7, 1977 [DE] Fed. Rep. of Germany ..... 2749680

[51] Int. Cl.[2] ..... H01R 39/00

[52] U.S. Cl. ..... 339/5 R; 174/9 F; 310/176; 339/112 L

[58] Field of Search ..... 174/9 F; 310/176; 339/5 R, 5 RS, 6 R, 6 RL, 7, 8 R, 8 PB, 8 RL, 112 L

[56] References Cited

U.S. PATENT DOCUMENTS

| | | | |
|---|---|---|---|
| 2,475,051 | 7/1949 | Raymond | 339/5 P |
| 2,575,409 | 11/1951 | Cooper et al. | 339/112 L X |
| 3,430,179 | 2/1969 | Shoji | 339/5 R |

*Primary Examiner*—Roy Lake
*Assistant Examiner*—DeWalden W. Jones
*Attorney, Agent, or Firm*—Connolly and Hutz

[57] ABSTRACT

Electrical power of high intensity is transmitted to a rotating electrode with the use of an apparatus, wherein a shaft is provided with a connecting joint which is rigidly connected to a cylindrical container serving as the rotating electrode. A trough filled with a low-melting alloy has a contact maker secured to it, and the latter has a flexible cable screwed thereto. A cover, which has the shaft passed through it, is insulatingly placed on the cover, and the shaft is provided with a disk, in the region of the cover.

6 Claims, 2 Drawing Figures

ELECTRICAL POWER TRANSMITTING APPARATUS

Figure 1:
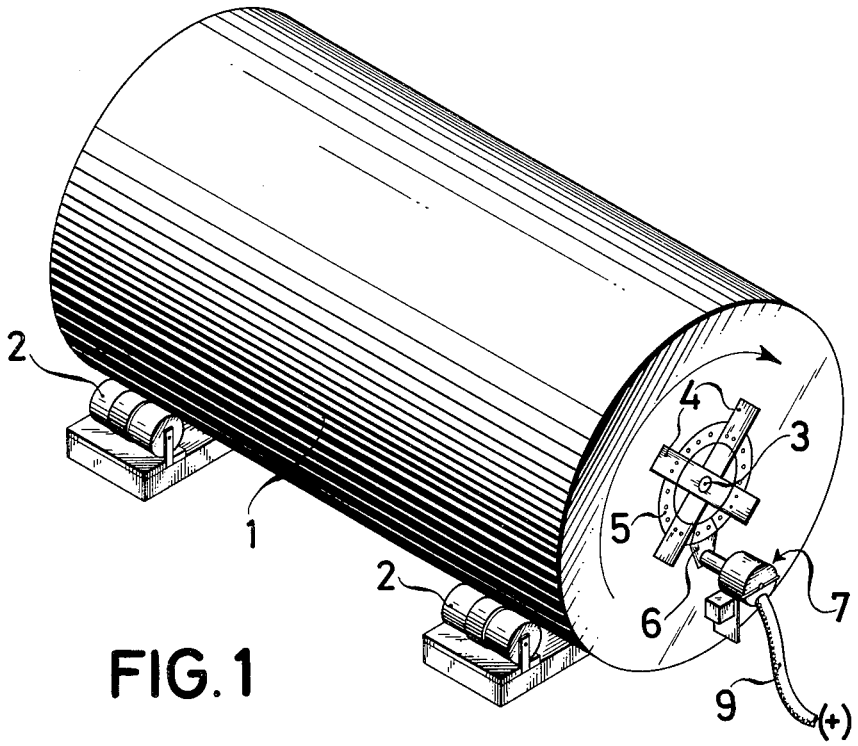

This invention relates to an apparatus permitting electrical power of high intensity to be transmitted to a rotating electrode.

In the electrolytic treatment of large containers which, for example, are to be electropolished or hard chromium plated, it has been a normal practice to fill the container with a liquid electrolyte. The container is simultaneously connected to form one of the electrodes, the other electrode which may be a rotating cathode or anode being disposed inside the container.

An electropolishing process and apparatus have been described in German Patent Specification "Offenlegungsschrift" 2,528,942. As disclosed therein, a large container is arranged so as to be horizontally and rotatably supported by a plurality of roller bearings. Passed through pipe connections, which are secured to the two ends of the container, symmetrically with respect to its longitudinal axis, is an electrically insulated and freely rotatable shaft. Secured close thereto and parallel with respect to the wall of the container is a wire gauze electrode which is held in position by means of electrode holders, the container being incidentally filled with the quantity of electrolyte necessary to cover the electrode. During the electropolishing operation, during which the container is caused to rotate slowly on its longitudinal axis, the shaft and electrode, which is connected to the negative pole of a DC-source, are at standstill.

The means used to connect the rotating container to the positive pole of the DC-source have not specifically been described in the above literature reference. It is however possible to establish the connection with the aid of a copper sleeve which is secured to the center portion of one of the two covers of the container. Rotatably mounted above the sleeve is a bush which has a conductive grease placed therein to improve the transfer of power and is flexibly connected to the DC-source.

German Patent Specification "Offenlegungsschrift" 1,808,865 describes a process, wherein polymerization vessels are hard chromium plated. To this end, the polymerization vessel is held in upright position, provided with a migrating anode and completely filled with electrolyte. The vessel, which is at standstill during the hard chromium plating, is connected to the negative pole of a DC-source and mercury, which is in a tank, is used to connect the rotating migrating anode to the positive pole of the DC-source. The mercury tank, which has the migrating anode tightly passed through it, is mounted above the vessel, concentrically with respect to the shaft of the anode. A rigid power supply line which is arranged so as to dip into the mercury leads to the DC-source.

The power transmitting device just described suffers from the disadvantage that only a small contact surface is available for the transfer of current from the copper sleeve to the greased bush so that the sleeve and bush are liable to become very hot. This means that the temperature at the contact area is increased and naturally also the electrical resistance which can only be overcome by the supply of more electrical power. In addition to this, in the event of the sleeve and bush becoming hot, the conductive grease may be rendered so fluid that it is liable to run out or undergo coking.

The use of mercury as a power transmitting medium is also not satisfactory in respect of the following points: Mercury is liquid at room temperature and therefore liable to run out during transport and use. This however is hazardous as mercury is a highly toxic substance injurious to the health of the operating personnel.

It is therefore an object of the present invention to provide an apparatus permitting electrical power of high intensity to be transmitted to a rotating electrode, without the need to employ metal structures which would be liable to become hot and mercury as a power transmitting medium.

The apparatus of the present invention comprises more particularly: a shaft carrying a connecting joint which is rigidly connected to a cylindrical container forming the electrode; a trough which is filled with a low-melting metal alloy and has a contact maker secured to it, the latter having a flexible cable screwed thereto; a cover which has passed through it the above shaft and which is insulatingly connected to the trough; and a disk which is mounted on the shaft, in the region of the cover.

Further preferred features of the present invention provide:

(a) for the trough to be filled with a metal alloy having a melting point higher than 30° C., advantageously higher than 50° C.;

(b) for the trough to be heated electrically;

(c) for the trough to be heated electrically and for the heating to be controlled through an automatic control; and (d) for the disk to have a diameter necessary for it to reach into the metal alloy with a surface area of 0.1 to 3 $mm^2$ per ampere of power passing therethrough.

During operation, the open side of trough forming part of the apparatus of the present invention, is always held in a horizontal position. As a result of this, the liquid metal alloy is definitely prevented from emerging from the trough. At the same time, it is ensured that the disk reaches with equal immersion depth into the liquid alloy in which it can be caused to rotate freely.

The connecting joint secured to a flange of the container, which is connected to form the movable electrode, the shaft installed within the connecting joint, the disk mounted on the shaft, the liquid alloy in the trough, and the contact maker, which has a flexible cable running to a DC-source screw-connected thereto, are the stations marking the current path in the apparatus of the present invention. The two bearing bushes which are arranged inside the cover carried by the trough and through which is passed the above shaft, undergo insignificant heating only. Metal alloys particularly suitable for use in the present apparatus comprise light soldering material STANNOL (no. 46) (this is a registered Trade Mark) which contains 90% of indium and has a melting point of 46° C.; alloys disclosed by LIPOWITZ (50% Bi, 27% Pb, 13% Zn, 10% Cd) which have a melting point of about 60° C.; alloys disclosed by WOOD (50% Bi, 25% Pb, 12.5% Sn, 12.5% Cd) which have a melting point of about 70° C.; and alloys disclosed by ROSE (50% Bi, 25% Pb and 25% Sn) which have a melting point of about 95° C.

No controlled heating of the trough is necessary in all those cases in which use is made of STANNOL inasmuch as the current of high intensity which is passed through the trough enables this metal alloy to be maintained at about 50° C., i. e. in the molten state.

After switch off, the metal alloy in the trough soon begins to solidify so that the apparatus of the present invention is reasonably easy to remove and transport.

Figure 2:
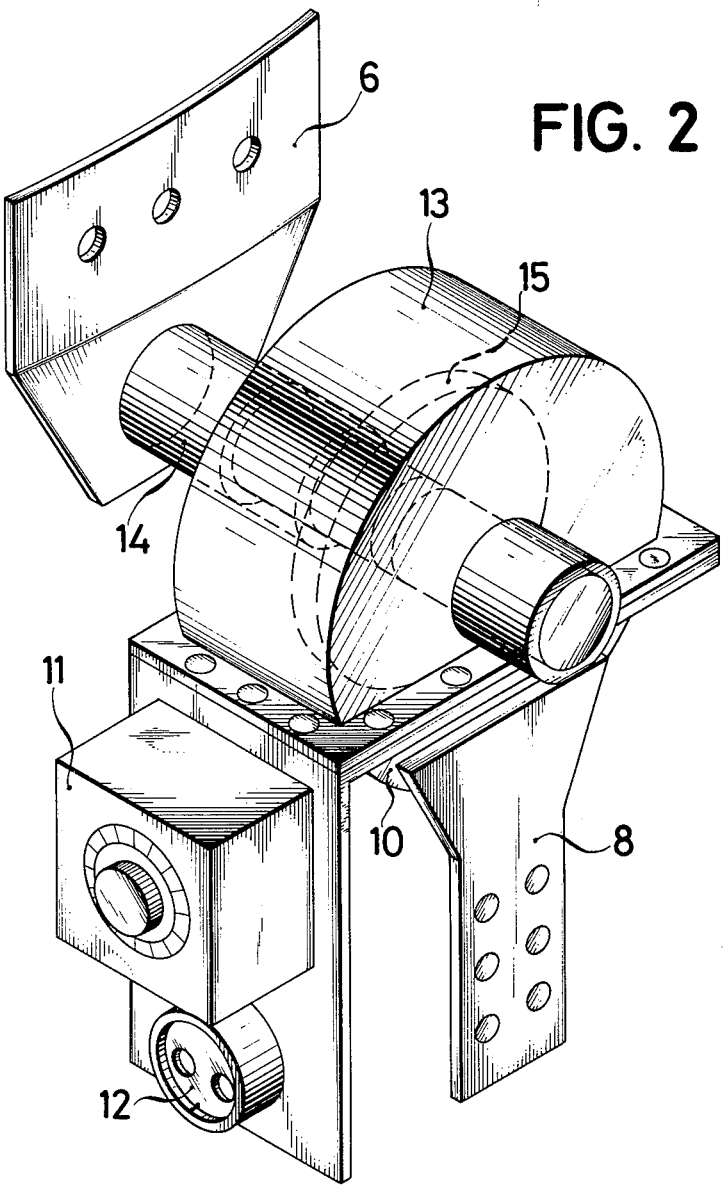

An exemplary embodiment of the apparatus of the present invention is shown diagrammatically in the accompanying drawings, of which FIG. 1 shows a cylindrical container arranged in a horizontal position which has the power transmitting apparatus of this invention secured to a central flange, and FIG. 2 shows the power transmitting apparatus in greater detail.

In FIG. 1, a cylindrical container 1 is rotatably mounted on rollers 2. It is partially filled with an electrolyte solution and connected to form a rotating electrode. Positioned inside the container 1 close to, and parallel with, the wall of the container is the other electrode which is secured to a shaft 3 by means of electrode holders. The shaft 3 is arranged so as to pass centrally through the container 1, and rotatably mounted on flat profiled sections 4 which are arranged in crosswise fashion. The flat profiled sections 4 are insulatingly secured to central flanges 5 provided in the two covers of the container 1. One of the two flanges 5 is electrically connected to the connecting joint 6 forming part of the power transmitting apparatus 7. Secured to a contact maker 8 of the power transmitting apparatus 7 is a flexible cable 9 which is connected to the positive pole of a DC-source. The shaft 3, which is held in position when the container is caused to rotate on its axis, is rigidly connected to the negative pole of the DC-source.

As shown in FIG. 2, the power transmitting apparatus comprises a trough 10 which should preferably be made up of copper. The trough 10 has the contact maker 8 secured to it, is filled with a low melting alloy and electrically heatable through a plug connection leading to a socket 12, the heating being controllable by means of an automatic control 11. The trough 10 is closed by means of a cover 13, the trough 10 and cover 13 being electrically insulated from one another. The cover 13 has passed through it a shaft 14 which is rotatably mounted in the cover 13. One of the two ends of the shaft 14 terminates in the connecting joint 6. Disposed inside the cover 13 on the shaft 14 is a disk 15 which is given a diameter large enough for it to dip with a large surface area into the molten metal alloy in the trough 10.

The apparatus of the present invention compares favorably with the prior art and this will more fully be described with reference to the electropolishing treatment of a 100 $m^3$ cylindrical container made up of material no. 14571, i. e. material complying with DIN-specification no. 17440 (DIN stands for German Industrial Standard). The electropolishing operation was effected as described in German Patent Specification "Offenlegungsschrift" 2,528,942. The current flow was 5000 amperes at initially 14 volts.

EXAMPLE 1: (Comparative Example)

A copper sleeve in a bearing bush which was greased so as to improve conductivity was used for transmitting electrical power from the rotating container to the rigid power supply line. The copper sleeve and bearing bush were rendered hot after an electropolishing operation period as short as 5 hours, and the voltage was found to increase to 18 volts. To continue the electropolishing, it was necessary continually to spray cooling water during the next 40 hours on to the copper sleeve and bearing bush so as to prevent the copper sleeve from seizing in the bearing bush.

EXAMPLE 2: (Invention)

Use was made of the power transmitting apparatus of this invention. The voltage increased to 14.5 volts during a 48 hour period of electropolishing treatment. In other words, it was not necessary for the apparatus to be cooled.

We claim:

1. A collector device for galvanic treatment from an electrical source of a rotatably mounted container having side faces, the collector device comprising a connecting piece, the connecting piece having upper and lower regions, fastening means connecting the upper region to one of the side faces of the container, a shaft rigidly connected to the lower region of the connecting piece, a cylindrical receiver, including a trough and a cover, insulating means connecting the cover to the trough, the cover having a pair of bearing bushings mounted in axial alignment in opposite sides of the cover, the shaft being rotatably inserted into the bearing bushings, a low temperature melting alloy disposed in the trough, a contact plate electrically connected to the trough, a flexible electric cable electrically connected to another portion of the contact plate for connecting the device to the electrical source, a disk secured to the shaft within the receiver, the disk having a diameter which is constructed and arranged to immerse a substantial area of the disk into the low temperature melting alloy in the trough whereby the current from the electrical source is transmitted through the device when the alloy is molten.

2. The collector device as claimed in claim 1, wherein the trough is filled with a metal alloy having a melting point higher than 30° C.

3. The collector device as claimed in claim 2, wherein the trough is filled with a metal alloy having a melting point higher than 50° C.

4. The collector device as claimed in claim 1, wherein the trough is heatable electrically.

5. The collector device as claimed in claim 4, wherein the heating is controlled by means of an automatic control.

6. The collector device as claimed in claim 1, wherein the disk has a diameter large enough so as to dip into said molten alloy with a surface area of 0.1 to 3 $mm^2$ per ampere of power passed through said device.

* * * * *